US005992420A

United States Patent [19]

Moriyama

[11] Patent Number: 5,992,420

[45] Date of Patent: Nov. 30, 1999

[54] CIGARETTE-ATTACHED EXTINGUISHING DEVICE

[76] Inventor: Yasunobu Moriyama, 4-24, 2-Chome, Kamiminami, Hirano-Ku, Osaka-Shi, Osaka-Fu, Japan

[21] Appl. No.: 09/133,318

[22] Filed: Aug. 13, 1998

[30] Foreign Application Priority Data

Jun. 25, 1998 [JP] Japan ..... 10-196685

[51] Int. Cl.[6] ..... A24F 13/18

[52] U.S. Cl. ..... 131/256; 131/187; 131/190; 131/235.1

[58] Field of Search ..... 131/256, 194, 131/187, 190, 235.1, 349; 431/146

[56] References Cited

U.S. PATENT DOCUMENTS

| | | | |
|---|---|---|---|
| 2,718,889 | 9/1955 | Claussen | 131/4 |
| 3,091,243 | 5/1963 | Guida | 131/349 |
| 3,102,543 | 9/1963 | O'Siel et al. | 131/4 |
| 4,121,597 | 10/1978 | Shin | 131/190 |
| 4,436,101 | 3/1984 | Seatts | 131/349 |
| 5,404,891 | 4/1995 | Kiribuchi | 131/349 |
| 5,595,195 | 1/1997 | Chang et al. | 131/349 |

FOREIGN PATENT DOCUMENTS

| | | |
|---|---|---|
| 38-16697 | 8/1938 | Japan . |
| 54-67800 | 5/1979 | Japan . |
| 55-21600 | 5/1980 | Japan . |
| 57-31198 | 2/1982 | Japan . |
| 59-6497 | 1/1984 | Japan . |
| 59-110594 | 7/1984 | Japan . |
| 60-133799 | 9/1985 | Japan . |
| 60-162491 | 10/1985 | Japan . |
| 61-17998 | 2/1986 | Japan . |
| 61-186397 | 11/1986 | Japan . |
| 62-25971 | 2/1987 | Japan . |
| 62-128788 | 8/1987 | Japan . |
| 63-84474 | 4/1988 | Japan . |
| 63-134698 | 9/1988 | Japan . |
| 63-158194 | 10/1988 | Japan . |
| 6-46497 | 6/1994 | Japan . |

*Primary Examiner*—Stanley S. Silverman
*Assistant Examiner*—Steven B. Leavitt
*Attorney, Agent, or Firm*—Nikaido, Marmelstein, Murray & Oram LLP

[57] ABSTRACT

The present invention relates to an attachment extinguishing device to be used by being wrapped around a cigarette, being capable of natural, reliable and swift extinguishment and also manual and forcible extinguishment as by the smoker crushing his lighted cigarette safely with his fingertips. To this end, the device comprises a wrapper (B) which comprises a total of three layers, i.e., an extinguishing inner band (15) of metallized film, a diametrically shrinkable intermediate band (16) of heat shrinkable film bonded to the innerband (15), and a heat insulating outer band (18) of pliable paper or nonwoven fabric bonded to the intermediate band (16), the inner and intermediate bands (15, 16) being embossed with parallel ridges (22) in rows which extend along and lengthwise of the cigarette (C) when the wrapper (B) is wrapped around the cigarette (C), thereby holding the inner band (15) substantially in linear contact with the circumferential surface of the cigarette (C).

9 Claims, 11 Drawing Sheets

CIGARETTE-ATTACHED EXTINGUISHING DEVICE

BACKGROUND OF THE INVENTION

Fires can break out, in many different situation, due to smoker's carelessness. Examples of such careless are when a smoker, during smoking, throws away his lit cigarette while walking, or throwing a lit cigarette out of a moving vehicle. Additionally if a smoker falls asleep with his lighted cigarette, a fire could start. When a smoker is walking, not only the smoker's carelessness but also the absence of a suitable and convenient extinguishing article, such as an ashtray, can result in a fire.

To prevent such accidents, Japanese Utility Model Kokai Hei 6-46497 proposed a convenient automatic extinguishing wrapper adapted to be used by being wrapped around a cigarette.

This known device comprises two layers: an extinguishing band 11, such as an aluminum foil or ceramic paper, having a fixed length L which is sufficient to be wrapped substantially one turn around the circumferential surface of a cigarette C, and a heat shrinkable band 12, such as a plastic film or a shape memory alloy, bonded to the said extinguishing band 11. This article is adapted to be wrapped around the circumferential surface of the cigarette C with the extinguishing band 11 placed inside.

According to the arrangement of this known configuration, when it is being used wrapped around the cigarette C, as soon as the fire ball or burning head moving from the tip of the lighted cigarette C toward its root reaches the wrapped position, the extinguishing band 11 creates a lack of oxygen in which contact with the open air is broken off. Furthermore, the heat shrinkable band 12 receiving heat from the extinguishing band 11 diametrically shrinks of itself to wrap around and hold down the extinguishing band 11; thus, the article may be said to be advantageous in that it can reliably and naturally extinguish the cigarette C.

However, as a result of continuing research since the development of the known device employing a readily available aluminum foil as said extinguishing band 11 and a heat shrinkable polyethylene film as said heat shrinkable band 12, I have found that the following problems remain to be solved.

The results of the tests on the known device reveal that the assembly of the aluminum foil 11 and the heat shrinkable film 12 bonded thereto forms nothing but a simple cylindrical body having a ore diameter corresponding to the circumferential surface of the cigarette C. The surface of the aluminum foil 11 in contact with the cigarette C is smooth; thus, when a smoker is smoking the cigarette by holding the latter between his or her fingertips, the assembly accidentally slips lengthwise along the cigarette C to change the wrapping position (desired position for extinguishment), so that the cigarette may erroneously be extinguished.

Particularly, the smoker's sweaty fingertips can stick to the heat shrinkable film 12 on the outside, making the above problem more significant. Though not erroneously extinguishing the cigarette, this article held between fingertips for smoking dives a feeling of discomfort.

Further, since the surface of the aluminum foil 11 in contact with the cigarette C is smooth and since the whole including the heat shrinkable film 12 is only of simple cylindrical form, the heat shrink force of the heat shrinkable film 12 cannot act quickly and efficiently as a wrapping and holding-down force for the cigarette C through the aluminum foil 11, so that it takes a long time for the cigarette C to extinguish completely.

On the other hand, since the heat of the cigarette C is propagated to the heat shrinkable film 12 on the outside through the aluminum foil 11, it is heated to a substantial high temperature. As a result, it is difficult, for example, for a smoker to manually forcibly distinguish his cigarette as by instantaneously crushing it with fingertips, and such operation entails a danger of skin burn.

With regard to this point, Japanese Utility Model Publication Sho 55-21600 discloses an automatic extinguishing article for cigarettes comprising three layers: a metal foil 1, paper 2 and a heat shrinkable film 3. In this case, the surface of the metal foil 1 in contact with a cigarette 4 is smooth, and said total of three layers only constitute a simple cylindrical form. Furthermore, since the heat shrinkable film 3 is exposed to the outside, the article slips along the cigarette 4 and likewise tends to catch the smoker's sweaty fingertips, causing a feeling of discomfort.

Particularly, in the arrangement of this known utility model, since the paper 3 is interposed between the metal foil 1 and the heat shrinkable film 3, the paper 3 reduces the heat shrink performance of the heat shrinkable film 3, degrading the extinguishing swiftness with which the cigarette 4 goes out completely.

SUMMARY OF THE INVENTION

The present invention has been accomplished to solve such problems in the prior art. Accordingly a first object is to provide an arrangement wherein a wrapper to be wrapped substantially one turn around the circumferential surface of a cigarette is composed of three layers: an extinguishing inner band of metallized film, a diametrically shrinkable intermediate band of heat shrinkable film bonded thereto, and a heat insulating outer band of soft paper or non-woven fabric bonded thereto. The heat insulating outer band is exposed, thereby eliminating the uncomfortable feeling caused by smoker's sweaty fingertips sticking thereto, and making it possible for the smoker to manually forcibly extinguish the cigarette as by crushing the cigarette with fingertips without the danger of being burned. This feature is particularly convenient for extinguishing cigarettes during walking when there is no suitable extinguishing article such as an ashtray.

Further, a second object is to provide an arrangement wherein of the three layers forming said wrapper, the extinguishing inner band of metallized film, and the diametrically shrinkable intermediate band of heat shrinkable film are directly bonded together, thereby absorbing and propagating the heat of the cigarette from the inner band to the intermediate band without loss, while said inner and intermediate bands of said wrapper are formed with rows of parallel ridges which extend lengthwise of the cigarette when the wrapper is wrapped around the circumferential surface of the cigarette. The inner band is kept in a relation in which it is substantially in linear contact with the circumferential surface of the cigarette, thereby permitting the heat shrinking force of the intermediate band to efficiently work as the wrapping and holding-down force on the cigarette through the inner band, thus enabling the cigarette to go out naturally and swiftly.

This is useful in such circumstances as when a smoker walks away from a smoking place or goes to sleep with his lighted cigarette placed on an ashtray. This is also effective to prevent the wrapper from accidentally slipping along and lengthwise of the cigarette to be deviated from the desired position for extinguishment.

A third object is to provide an arrangement wherein the wrapper composed of said total of three layers is distributively formed with a number of open air suction holes arranged in a dotted line pattern as at whole and communicating with openings in a tip paper wrapper around a cigarette filter. This permits open air to be drawn into the smoker's mouth through the open air suction holes while attaining said automatic extinguishing, thereby permitting the smoking of the filter-tipped cigarette without any trouble. The open air suction holes in the wrapper can be formed simultaneously with the formation of openings in the tip paper in the filter-tipped cigarette manufacturing process.

Other objects will become apparent from the following description of preferred embodiments of the invention.

DESCRIPTION OF THE PREFERRED EMBODIMENTS

Figure 1:
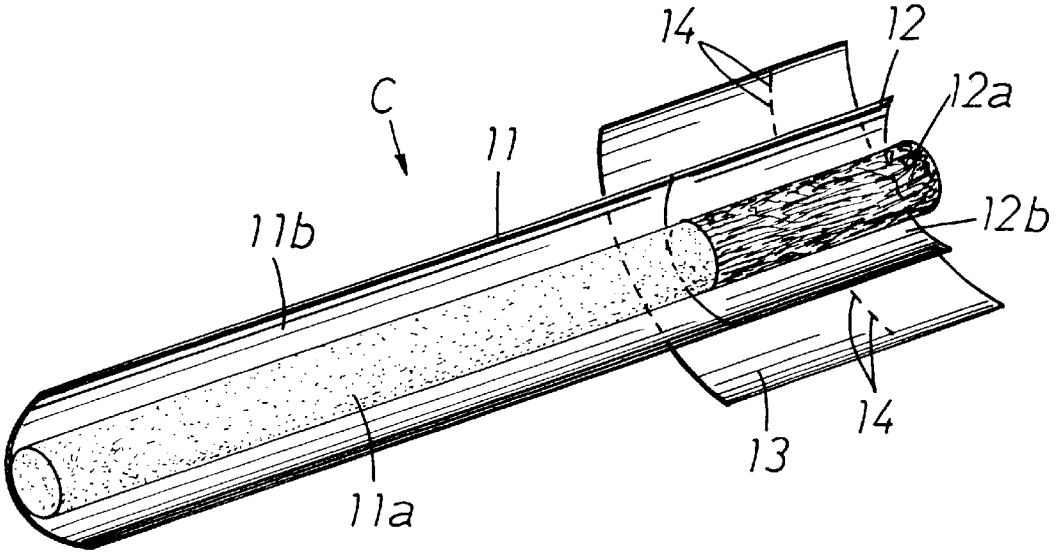
FIG. 1 is a perspective view, partly exploded, of a cigarette.
Figure 2:
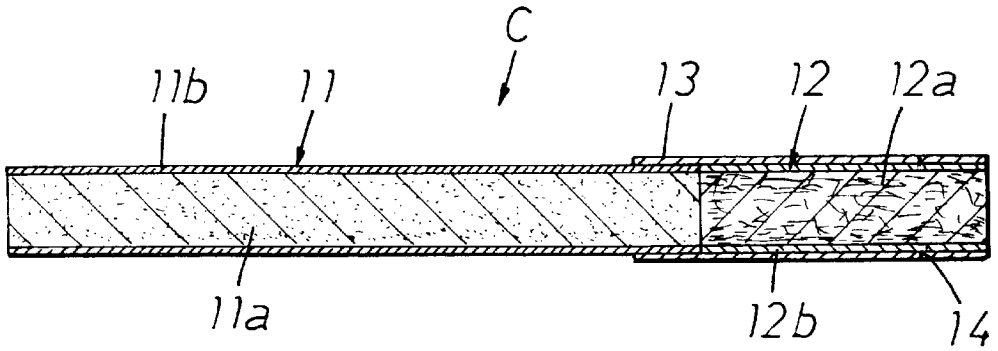
FIG. 2 is a side view, in section, of said cigarette.

The concrete arrangement of the present invention will now be described in detail with reference to the drawings. FIGS. 1 and 2 show a commercially available typical filter-tipped cigarette C. The numeral 11 denotes cylindrical tobacco column which comprises cut tobacco 11*a* and wrapping paper 11*b* wrapping around the same. The tobacco column 11 is usually about 55–70 mm in length and about 15–27 mm in circumference, and the density of the cut tobacco 11*a* filled therein is about 200 mg/cm$^3$–270 mg/cm$^3$.

Further, numeral 12 denotes a filter of the same thickness as that of the tobacco column 11, which filter is series-connected to the root of said tobacco column and comprises a bunch of fibrous filter material (fiber bunch) 12*a* and wrapping paper 12*b* wrapping around the same. There is not only the so-called acetate filter which employs cellulose acetate as said fiber bunch 12*a* but also a filter of dual construction comprising the so-called charcoal filter having activated charcoal dispersedly added therein. In either case, the length of the filter 12 is usually about 25–30 mm.

Further, numeral 13 denotes tip paper wrapped around the tobacco column 11 and the filter 12 to integrally join them, the tip paper having a number of small openings 14 formed therein in a circumferentially extending dotted line pattern, by using static electricity, laser or other processing means.

Therefore, in filter-tipped cigarette C, the thin open air is drawn into the smoker's mouth from around the cylindrical periphery through the openings 14 in the tip paper 13 and the smoke from the cut tobacco 11*a* is drawn into the smoker's mouth from the middle portion, so that the smoker can enjoy the smoking flavor generated from the cut tobacco 11*a*.

Figure 3:
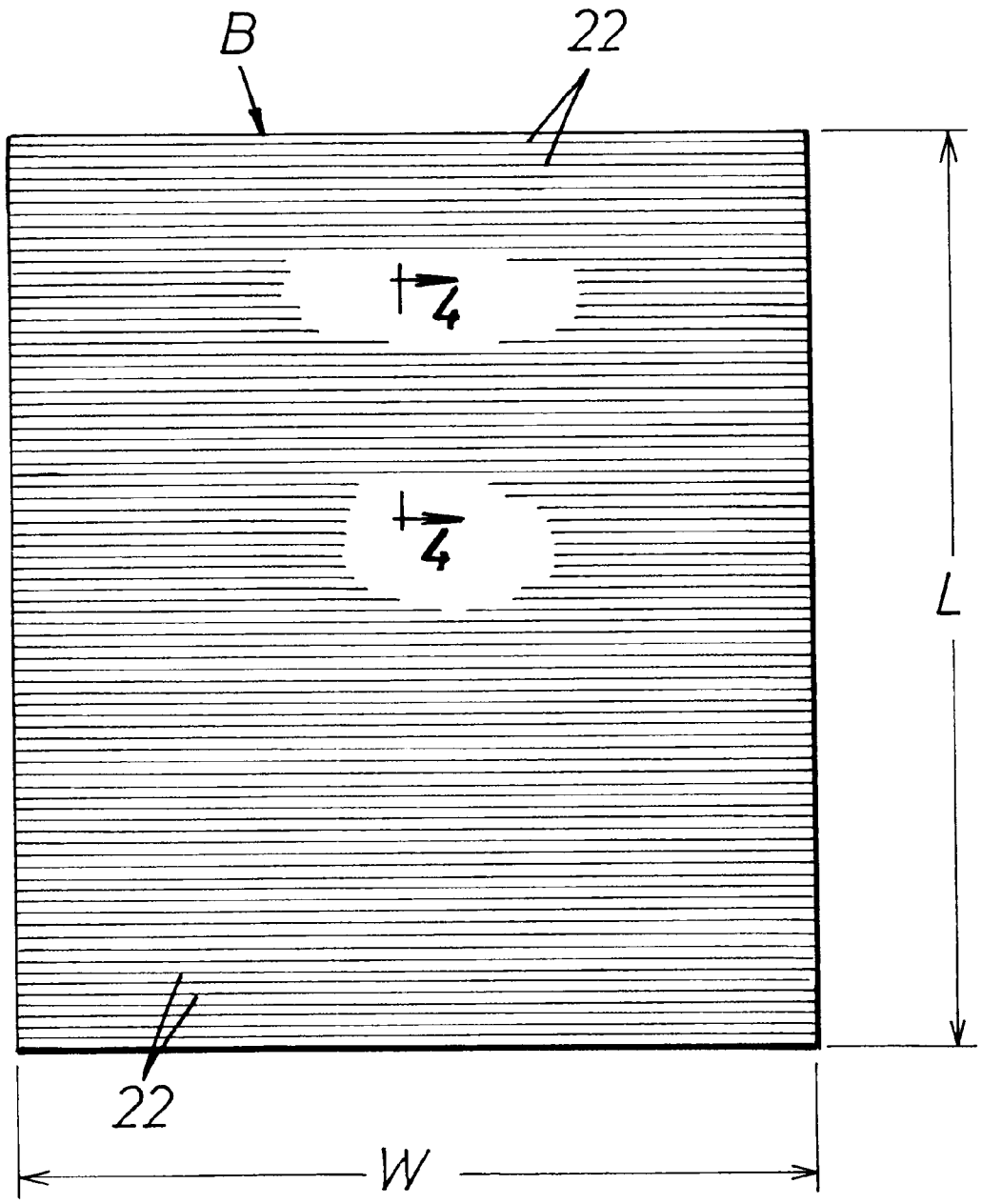
FIG. 3 is a developed plan view of a wrapper employed in the present invention.
Figure 4:
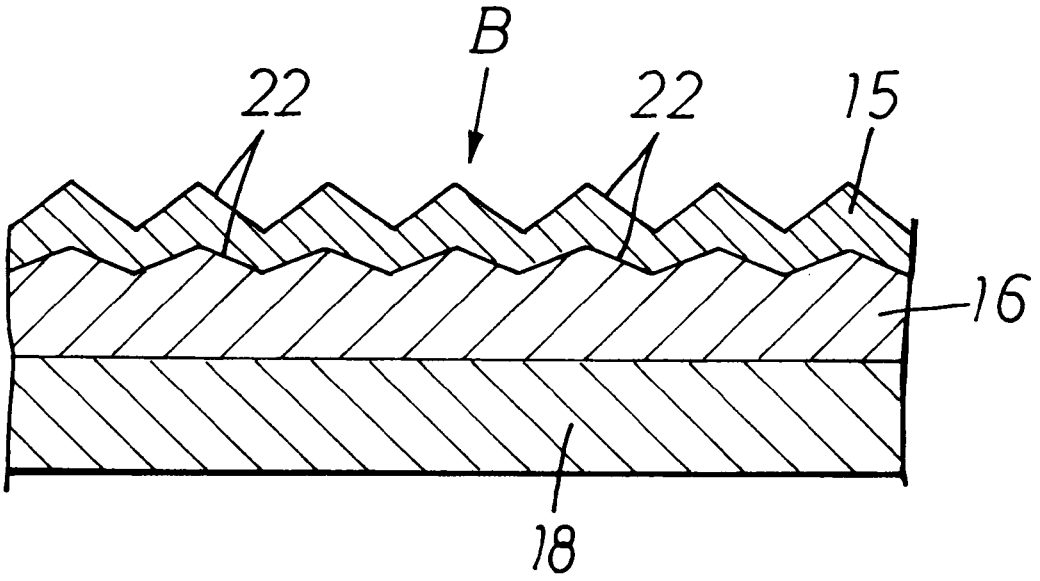
FIG. 4 is an enlarged sectional view taken along the line 4—4 in FIG. 3.
Figure 5:
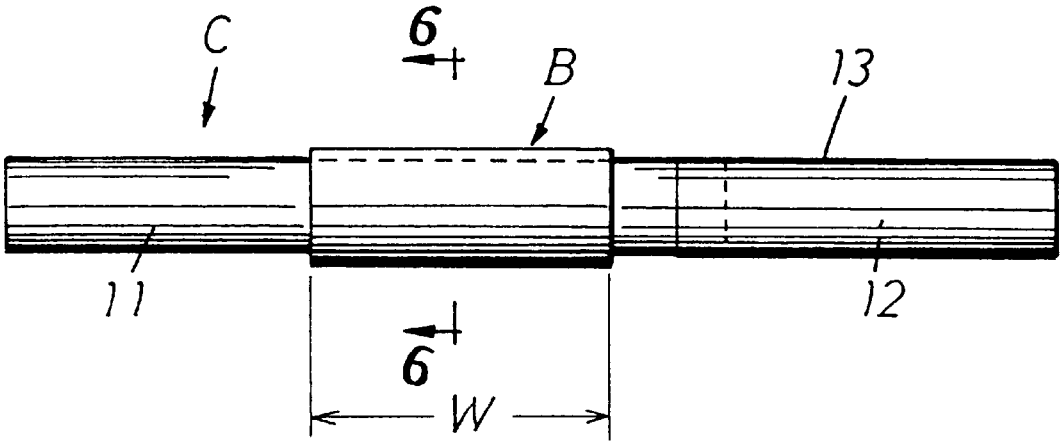
FIG. 5 is a side view of said wrapper wrapped around a cigarette.
Figure 6A:
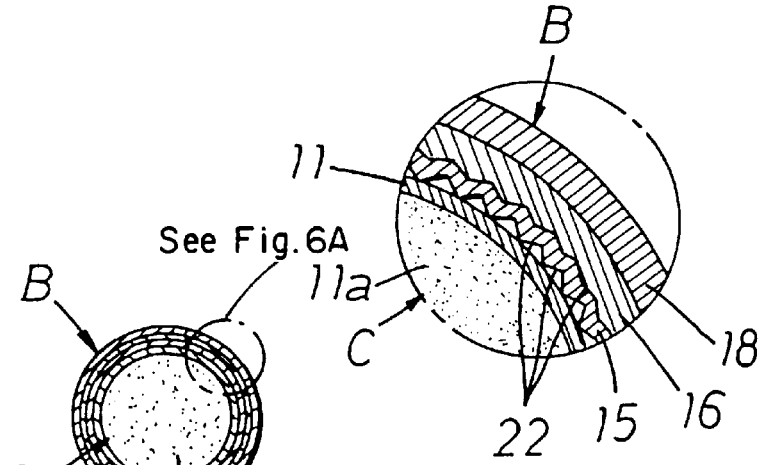
FIG. 6 is an enlarged sectional view taken along the line 6—6 in FIG. 5.
Figure 6:
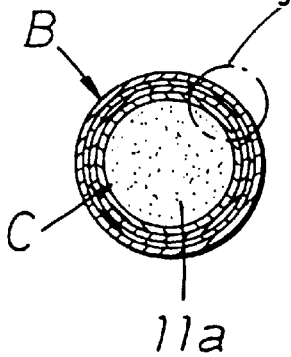

On the other hand, FIGS. 3 and 4 show a wrapper B for extinguishing cigarette C, said wrapper being obtained by cutting a long-sized band material M of fixed width W into rectangles or squares having a length L sufficient to be wrapped substantially one turn around the circumferential surface of the cigarette C as shown in FIGS. 5 and 6, the band material M comprising the following three layers bonded together.

Figure 7:
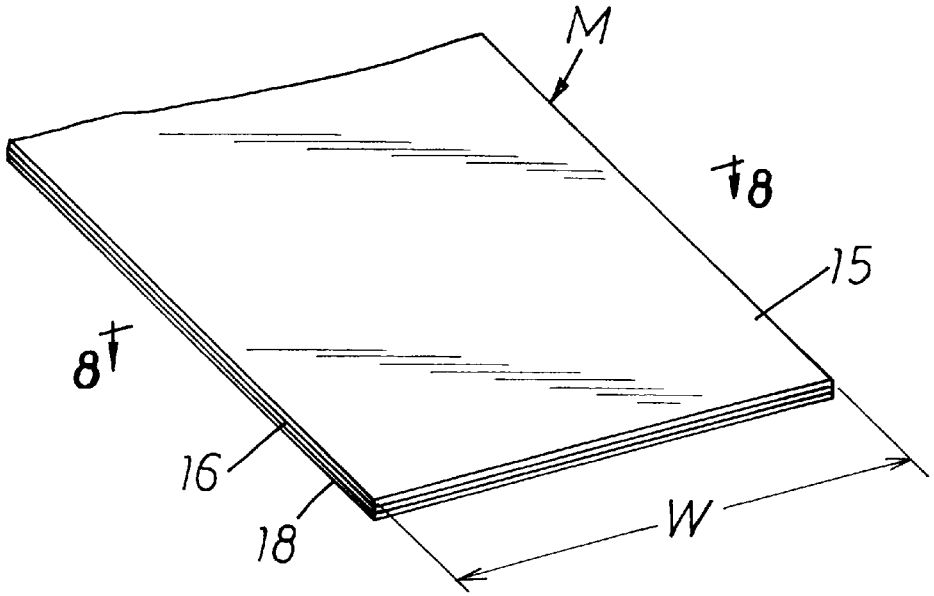
FIG. 7 is a perspective view showing the bands of said wrapper.
Figure 8:
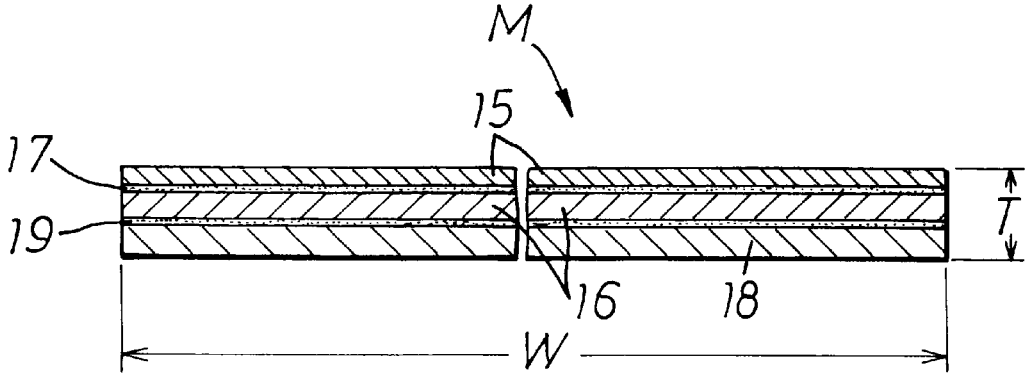
FIG. 8 is an enlarged sectional view taken along the line 8–8 in FIG. 7.

That is, the band material M of the wrapper B is in the bonded state having a thickness T of about 70 microns at most as shown in FIGS. 7 and 8. The numeral 15 denotes a single layer of extinguishing inner band to be in contact with the circumferential surface of the cigarette C, formed of an aluminum foil or metallized film having a thickness of about 7–10 microns.

The numeral 16 denotes a single layer of diametrically shrinkable intermediate band bonded to the whole of one surface of said extinguishing inner band 15 through a naturally setting type adhesive agent 17 and formed of a heat shrinkable polyethylene, polyester, polypropylene, vinylidene chloride or other plastic film having a shrinking temperature of about 60° C.–100° C. The thickness of the intermediate band 16 is about 20–30 microns.

The numeral 18 denotes a single layer of heat insulating outer band bonded to the whole of the remaining surface of said diametrically shrinkable intermediate band 16 through a naturally setting type adhesive agent 19 and formed of a pliable paper or nonwoven fabric. Therefore, there is no danger of the smoker's sweaty fingertips being caught thereby. The thickness of the outer band 18 is the same as that of said intermediate band 16, being about 20–30 microns, and it is possible to print letters, figures, signs, emblems or the like for advertisement on the exposed surface.

Since the diametrically shrinkable intermediate band 16 to form wrapper B is bonded to the adjoining extinguishing inner band 15 and heat insulating outer band 18 through the naturally setting type adhesive agents 17, 19, natural drying takes place in each bonding operation, thus allowing said adhesive agents 17, 19 to cure, with the result that there is no danger of said intermediate band 16 being undesirably thermally deformed during preparation of the band material M of the wrapper B.

The band material M of the wrapper B prepared in the form of a total of three layers bonded together as described above is then, as is clear from FIGS. 9 and 10, fed at its one lengthwise end into the nip between an embossing roll 20 and a smoothing roll 21 receiving a pressing force therefrom, and the pressing force from the embossing roll 20 is applied from the direction of said extinguishing inner band 15, whereby the two layers of extinguishing inner band 15 and diametrically shrinkable intermediate band 16 are formed with parallel ridges 22 in rows.

That is, with the embossing depth of the embossing roll 20 being set at about 10–15 microns in correlation with the extinguishing inner band 15 having a thickness of about 7–10 microns, the two layers of extinguishing inner band 15 and diametrically shrinkable intermediate band 16 are formed with parallel ridges 22.

In this case, the heat insulating outer band 18 is in the supported state in contact with the smooth roll 21 and comprises a pliable paper or nonwoven fabric; therefore, the pressing force from said embossing roll 20 is absorbed and buffered thereby, with the result that the exposed surface of the outer band 18 is kept in the initial flat state.

And the band material M of the wrapper B with said extinguishing inner bond 15 and diametrically shrinkable intermediate band 16 formed with ridges 22 in rows is delivered from the nip between the embossing roll 20 and the smooth roll 21 and then cut into lengths L each sufficient to be wrapped one turn around the circumferential surface of the cigarette C; thus, it has been finished as the rectangular or square wrapper B as shown in FIGS. 3 and 4. Thus, wrappers B can be mass-produced at low cost.

The length L of the wrapper B is equal to the circumferential length of the cigarette C plus an overlapping allowance of about 2–3 mm (not shown), and the state of the wrapper wrapped around the cigarette C is fixed and maintained by the adhesion applied to the overlapping allowance.

Further, the width W of the wrapper B is dimensioned to be about 15–25 mm in consideration of the correlation with the overall length of the cigarette C and the thickness of fingertips. If the width W is greater than about 25 mm, the smokable portion of the cigarette C is unnecessarilly decreased, and the wrapper B tends to be easily breakable together with the cigarette C.

Conversely, if the width W of the wrapper B is less than about 15 mm, this causes uncertainty in achieving reliable extinguishment of the cigarette C and makes it difficult to slide the wrapper B in order to change the desired position for extinguishment or to apply manual operation for forcible instantaneous extinguishment as by crushing the cigarette with fingertips holding the wrapper B.

Figure 9:
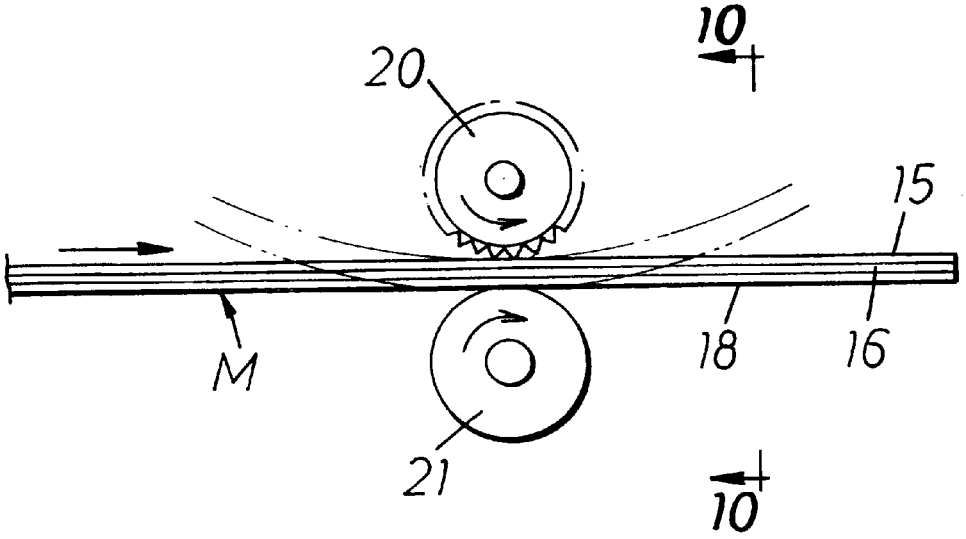
FIG. 9 is a side view showing an embossing operation on the bands of said wrapper.
Figure 10:
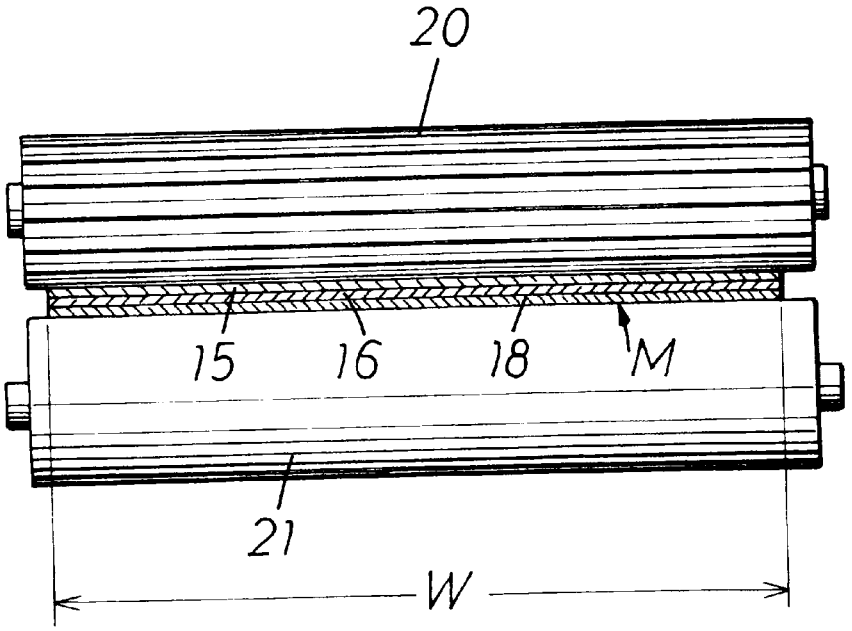
FIG. 10 is an enlarged sectional view taken along the line 10—10 in FIG. 9.

At any rate, the wrapper B finished in the rectangular or square form as shown in FIGS. 3 and 4 is, as suggested by phantom lines in FIG. 9, subjected to the pressing force from embossing roll 20 and arcuately bent with the extinguishing inner band 15 disposed on the interior angle side, whereby a so-called acquired permanent bend is imparted to the wrapper; thus, in conformity with said acquired permanent bend, the wrapper B is wrapped around the circumferential surface of the cigarette C such that the ridges 22 formed by said embossing treatment extend along and lengthwise of the cigarette C. The wrapped state is as shown in FIGS. 5 and 6.

Then, this results in the extinguishing inner band 15 of the wrapper B being maintained at ridges 22 in substantially linear contact with the circumferential surface of the cigarette C. And unless a manual forcible slide operating force is applied to the wrapper B, there is no danger of the wrapper, in its natural state, accidentally sliding, much less the danger of it slipping off the cigarette C.

Further, since the two layers of extinguishing inner band 15 and diametrically shrinkable intermediate band 16 are formed with ridges 22 in rows which are to extend lengthwise of the cigarette C, the ridges 22 serve as means for producing an acquired permanent bend which enables the diametrically shrinkable intermediate band 16 to swiftly heat-shrink, and the shrinking force exerted by the extinguishing inner band 15 can be reflected without loss as a wrapping and holding-down force on the cigarette C.

Figure 11:
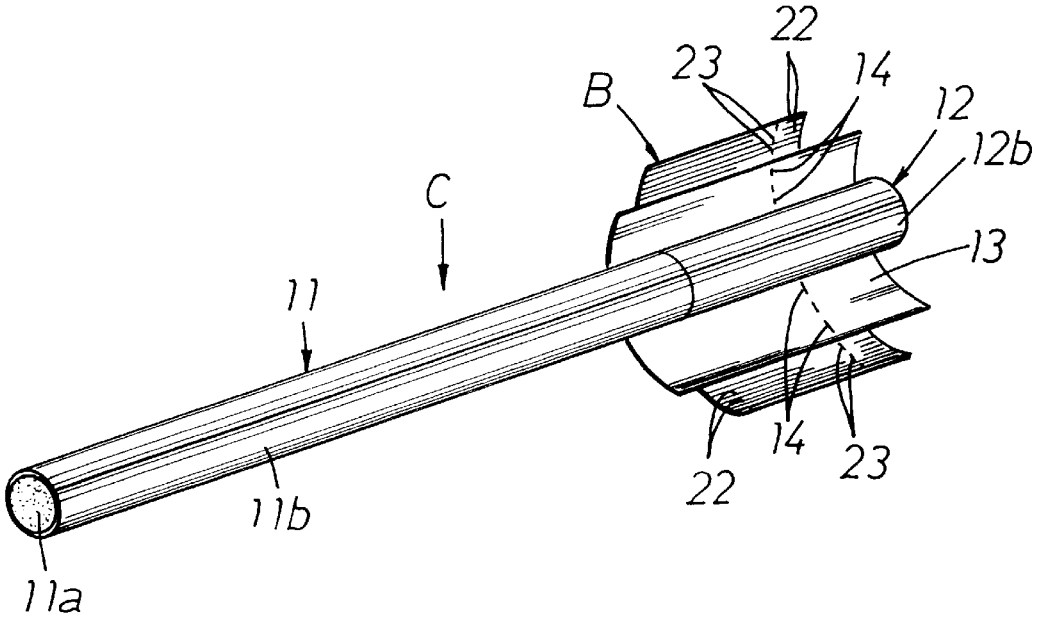
FIG. 11 is a perspective view, partly exploded, of another embodiment of the invention.
Figure 12:
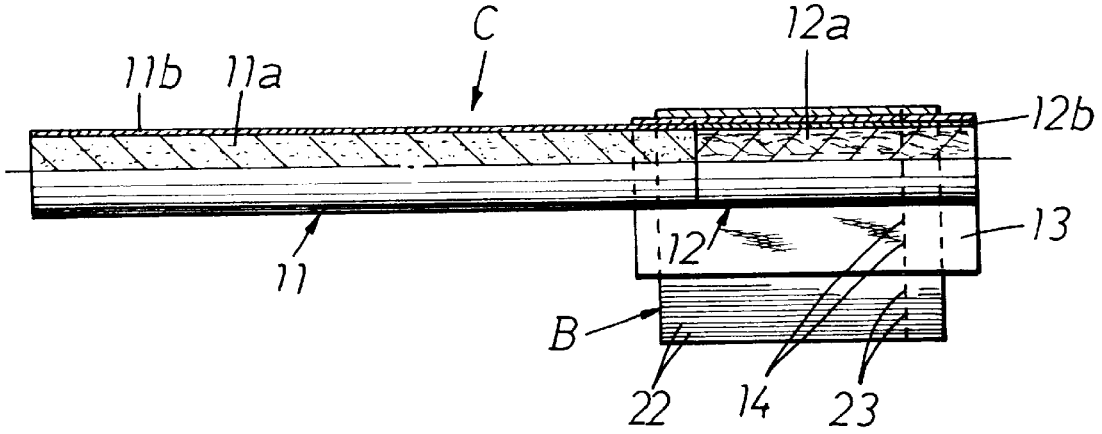
FIG. 12 is a partly developed half-sectional view of FIG. 11.

Next, FIGS. 11 and 12 show another embodiment of the invention, wherein as is clear therefrom, the wrapper B comprising a total of three layers of said extinguishing inner band 15, diametrically shrinkable intermediate band 16 and heat insulating outer band 18 may be distributively formed with a number of open air suction holes 23 arranged in a dotted line pattern and communicating with said openings 14 in the tip paper 13 wrapping around the filter 12 of the cigarette C.

In the process of producing the filter-tipped cigarette C, a number of such open air suction holes 23 can be formed in the wrapper B at a stroke simultaneously with the openings 14 in the tip paper 13 by static electricity, laser or other processing means after wrapping said wrapper B around the circumferential surface of the tip paper 13 in an overlap state.

However, unlike the tip paper 13 of the filter-tipped cigarette C being in the fixed state, the wrapper B having open air suction holes 23 distributively formed therein is adapted to be manually forcibly slid along and lengthwise of the cigarette C.

In addition, since the rest of the arrangement in the embodiment shown in FIGS. 11 and 12 is the same as in the embodiment shown in FIGS. 3–6, a detailed description thereof is omitted by entering, in FIGS. 11 and 12, only the reference characters corresponding to those used in FIGS. 3–6.

Figure 13:
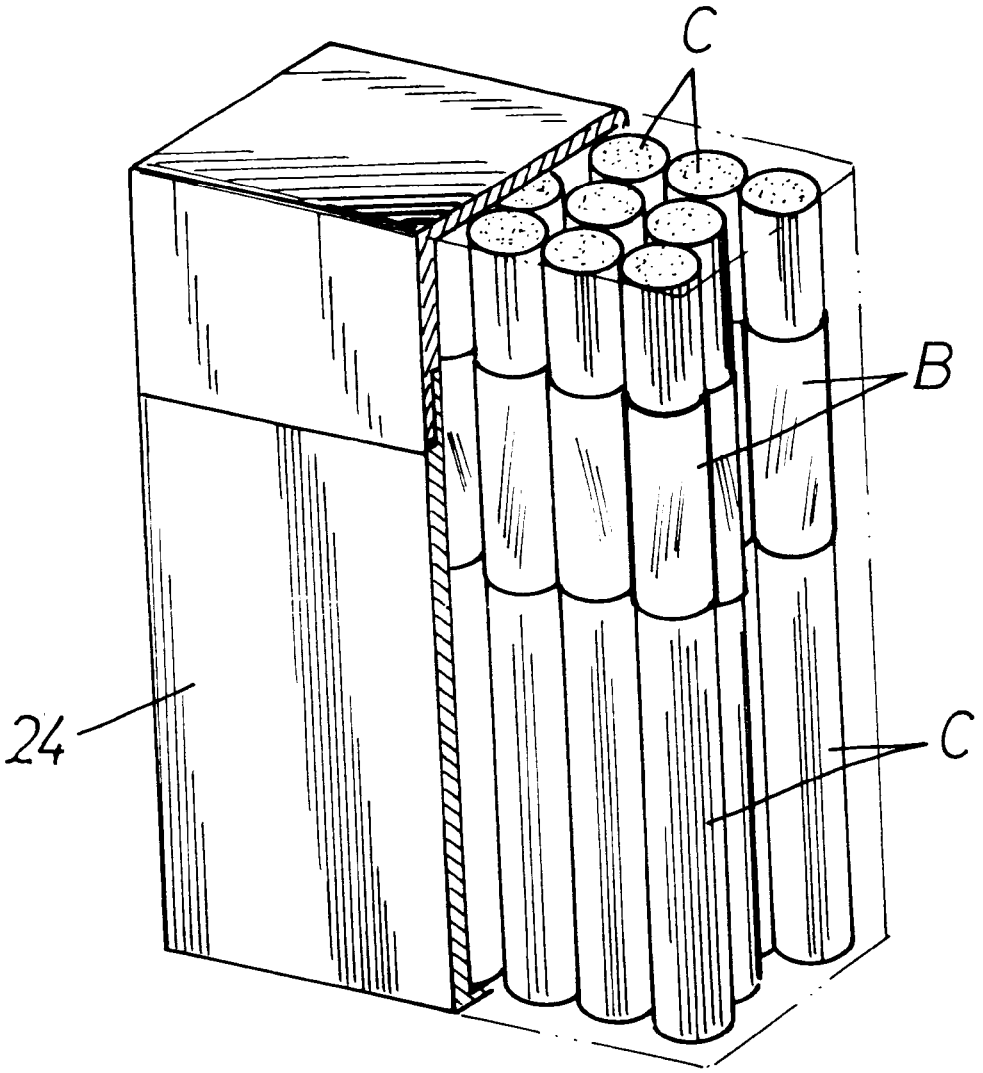
FIG. 13 is a perspective view showing the packed salable state of cigarettes having wrappers wrapped therearound.

The wrapper B of the arrangement has a total of three layers which are at most about 70 microns in thickness and therefore it is integrally wrapped about one turn around the circumferential surface of the cigarette C and such cigarettes, with the wrappers B attached thereto in advance, can be reasonably packed in a known cigarette packing box 24 as shown in FIG. 13 and put on sale.

However, wrappers B may be received, in a developed state as shown in FIGS. 3 and 4 and in sets of a fixed number, in a special exclusive packing box (not shown) and put on sale, so that a smoker who buys such box may use the wrappers by wrapping them around cigarettes C.

In either case, when using the present invention, the smoker has only to slide the wrapper B wrapped around the cigarette C, as shown in FIGS. 5 and 6, with his or her fingertips until the wrapper is stopped at the desired position for extinguishment.

Then, as soon as the fire ball or head moving from the tip of lighted cigarette C toward the root thereof reaches the position where the wrapper B is wrapped, the heat received by the extinguishing inner band 15 is propagated to the diametrically shrinkable intermediate band 16, so that the heat shrinking force from the intermediate band 16 serves as a wrapping and holding-down force on the cigarette C through the inner band 15, establishing a state of lack of oxygen in which contact with the open air is broken off, thus effecting natural and reliable extinguishment.

Figure 14:
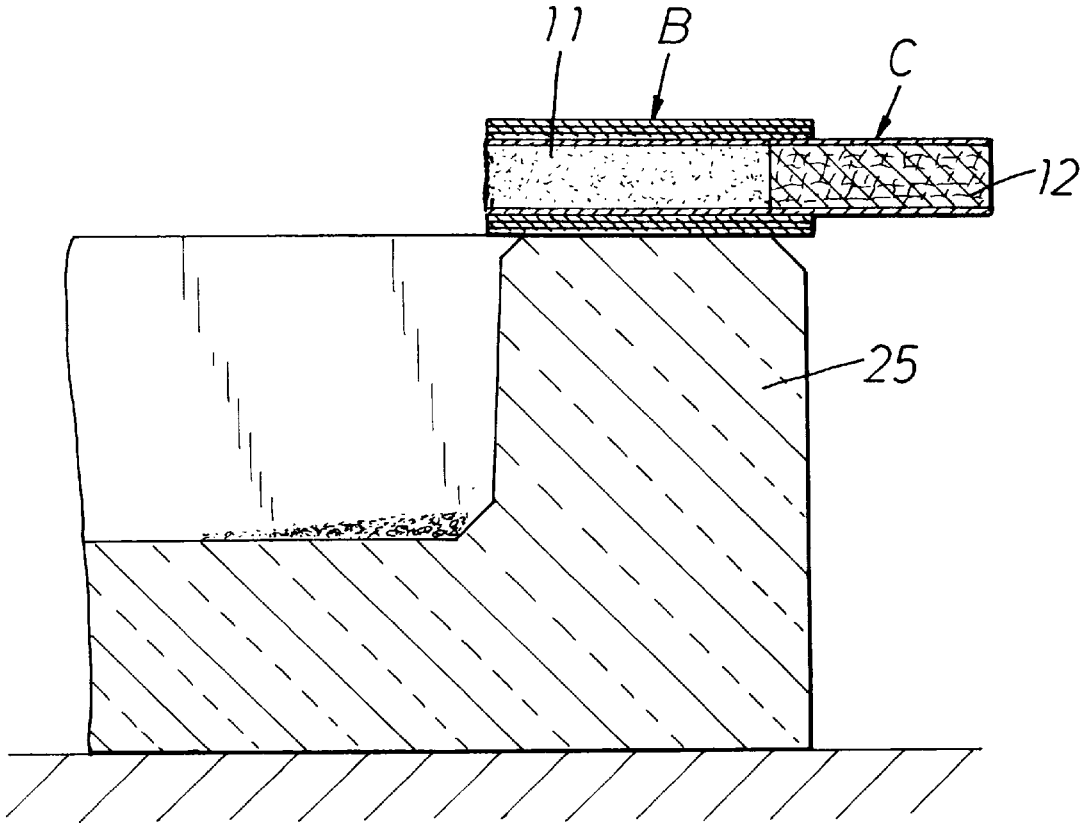
FIG. 14 is a side view, in section, showing the state of use in which a lighted cigarette is placed on an ashtray.
Figure 15:
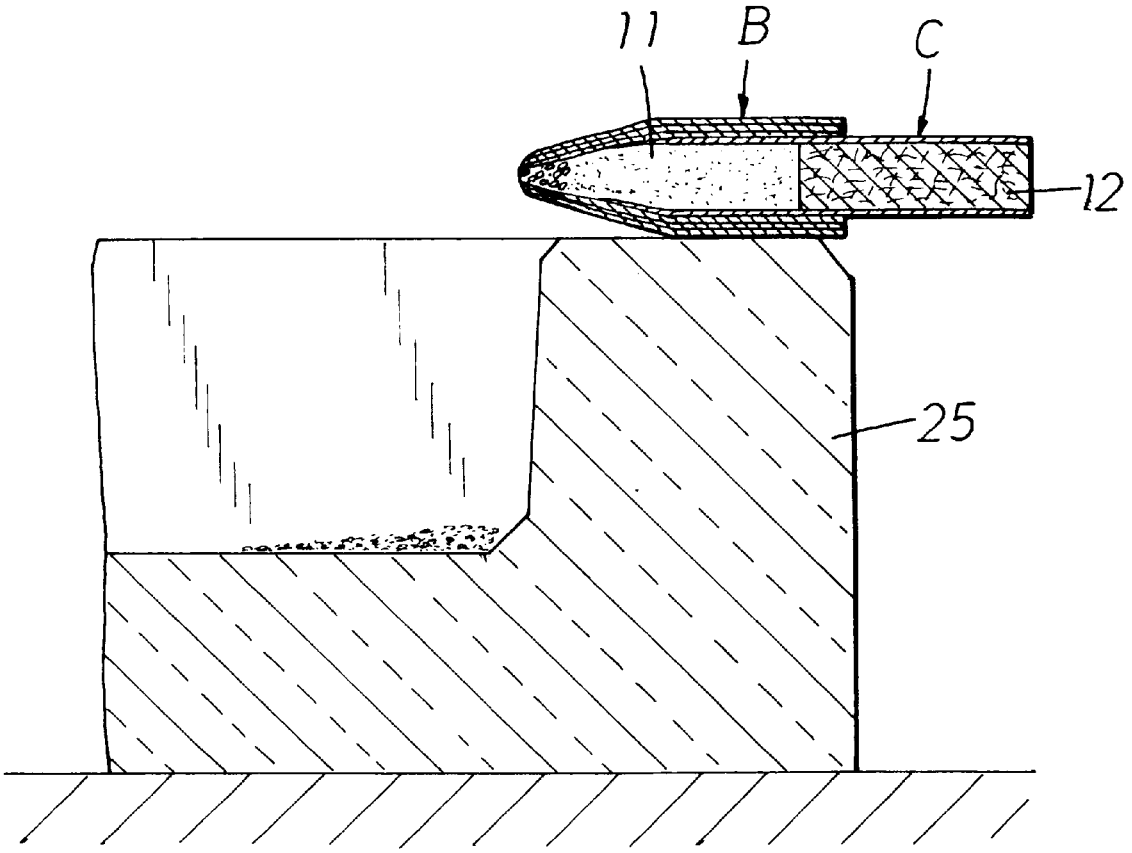
FIG. 15 is a side view, in section, showing the extinguished state of the cigarette continued from FIG. 14.

Therefore, even if a smoker moves away from the smoking place or goes to sleep with his lighted cigarette C placed on an ashtray 25 as shown in FIGS. 14 and 15, for example, there is a significantly reduced danger of a fire being started.

In this connection, according to the results of experiments on the present invention, 10 seconds after the cigarette C was extinguished, the cigarette C was immersed in thinner, embedded in cotton or puffed again at the root thereof, but no ignition or combustion occured.

Furthermore, since the two layers of extinguishing inner band 15 and diametrically shrinkable intermediate band 16 which constitute wrapper B have been embossed with parallel ridges 22 extending along and lengthwise of the cigarette C; therefore, forming said two layers with an acquired permanent bend in advance ensures that the intermediate band 16 receiving heat from said inner band 15 swiftly and smoothly shrinks, making it possible to greatly reduce the time required for extinguishment.

Further, because of the natural, quiet, swift and vigorous extinguishment, the extinguished portion of the cigarette C becomes rigid, with the result that partly because of said extinguished portion being wrapped and held down by the extinguishing inner band 15 of the wrapper B, there is no danger that a significant amount of ash will fall down to soil the area around the ashtray 25 in an unsightly manner.

Figure 16:
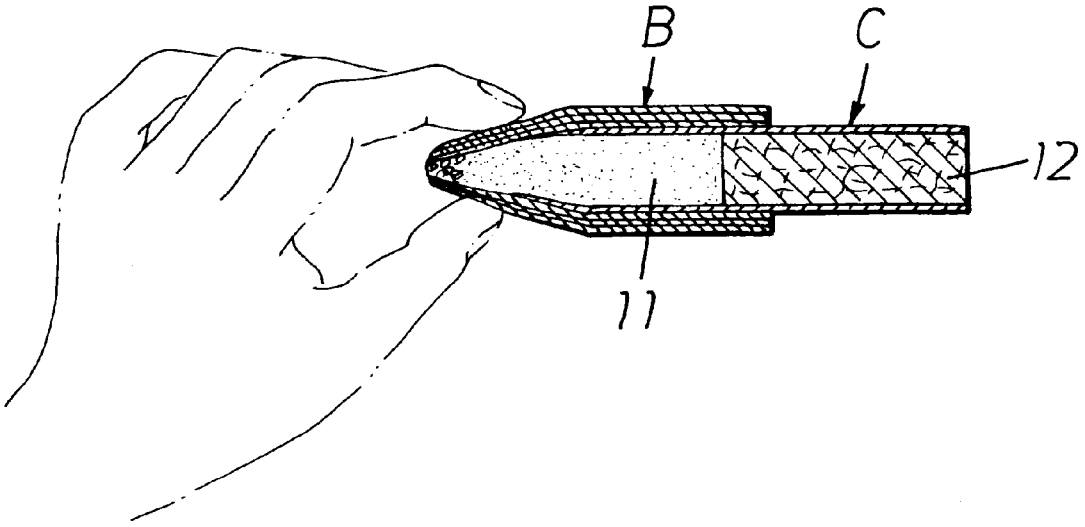
FIG. 16 is a sectional view showing the extinguished state with fingertips nipping the wrapper.
Figure 17:
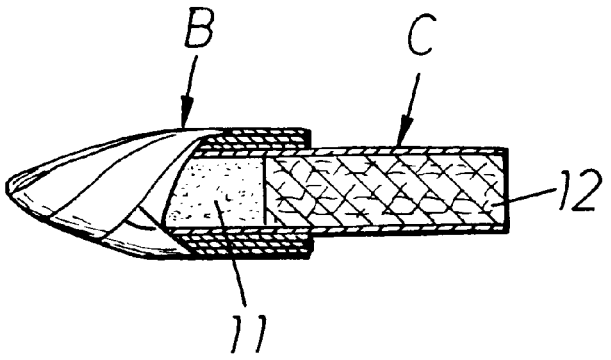
FIG. 17 is a side view, partly broken away, showing the wrapper in the state shown in FIG. 16.

On the other hand, during walking with no suitable extinguishing article, such as an ashtray, the smoker can manually forcibly extinguish the cigarette C as by crushing the wrapper B wrapped around the cigarette C with fingertips as shown in FIGS. 16 and 17, in which case since the outer band 18 of the wrapper B is in the form of a pliable paper or nonwoven fabric which insulates heat, there is no danger of fingertips being burnt. The smoker may carry his instantaneously extinguished cigarette C to a place where a trash can is installed and put it in the trash can; thus, the cigarette C can be extinguished regardless of time and place, being very convenient.

As has been described so far, the present invention provides an extinguishing device attached to a cigarette C, comprising a wrapper B of a total of three layers, a first layer of extinguishing inner band 15 of aluminum foil or metallized film, a second layer of diametrically shrinkable intermediate band 16 of heat shrinkable film bonded to inner band 15 through a naturally setting type adhesive agent 17, and a third layer of heat insulating outer band 18 of pliable paper or nonwoven fabric bonded to said intermediate band 16 through a naturally setting type adhesive agent 19. The inner and intermediate bands 15 and 16 are formed with parallel ridges 22 in rows by an embossing treatment applied in the direction of the inner band 15.

Wrapper B is wrapped substantially one turn around the circumferential surface of the cigarette C such that ridges 22 extend along and lengthwise of the cigarette C, thereby holding inner band 15 substantially in linear contact with the circumferential surface of the cigarette C. Thus, the invention has the effect of completely solving the problems in the prior art.

That is, according to the above arrangement of the present invention, the wrapper B to be wrapped substantially one turn around the circumferential surface of the cigarette C comprises a total of three layers, a first layer of extinguishing inner band 15 of metallized film, a second layer of diametrically shrinkable intermediate band 16 of heat shrinkable film bonded thereto, and a third layer of heat insulating outer band 18 of pliable paper or nonwoven fabric bonded thereto. Since heat insulating outer band 18 is in its exposed state, there is no danger of the smoker's sweaty fingertips being caught, and smooth smoking is ensured, and even during walking with no suitable ashtray at hand, the smoker can manually forcibly extinguish the cigarette C by crushing it with his fingertips. The reason is that the danger of burning the smoker's fingertips is prevented by heat insulating outer band 18.

Further, of the three layers forming said wrapper B, the extinguishing inner band 15 of metallized film, and the diametrically shrinkable intermediate band 16 of heat shrinkable film are directly bonded together, thereby absorbing and propagating the heat of the cigarette C from the inner band 15 to the intermediate band 16 without loss. The embossing treatment applied in the direction of inner band 15 forms the two layers with parallel ridges 22 in rows which are to extend along and lengthwise of the cigarette C. The acquired permanent bend produced in advance by said ridges 22 acts to enable the intermediate band 16 to swiftly heat-shrink, and the shrinking force thereof can be efficiently reflected without loss as a wrapping and holding-down force on the cigarette C exerted by the inner band 15. As a result, even if a smoker, for example, moves away from a smoking place or goes to sleep with his lighted cigarette C placed on an ashtray 25, the cigarette C can be naturally, reliably, and swiftly extinguished, so that there is a reduced danger of a fire being started, and the danger of soiling the area around the ashtray 25 in an unsightly manner is also reduced.

Further, when the wrapper B is wrapped around the cigarette C, the ridges 22 embossed on the extinguishing inner band 15 of wrapper B extend parallel and along and lengthwise of the cigarette C and are held substantially in linear contact with the circumferential surface of the cigarette C; therefore, unless the smoker applies a manual slide operating force to the wrapper B, there is no danger of the wrapper B, in its natural state, accidentally sliding along the cigarette C, nor is the danger of an erroneous extinguishing operation taking place owing to deviation of the desired position for extinguishment.

Particularly, if this arrangement is employed with the previously described suction holes, in addition to the achievement of the various effects described above, there is an effect that the open air effective for the smoking of the filter-tipped cigarette C can be drawn into the smoker's mouth through the opening 14 in the tip paler 13 from a number of open air suction holes 23 distributively formed in the wrapper B.

What is claimed is:

1. An extinguishing device for a cigarette, said extinguishing device comprising:

an inner band comprising a first layer of material, said inner band comprising one of a metallized film and an aluminum foil;

an intermediate band comprising a second layer of material, said intermediate band comprising a heat shrinkable film bonded to said inner band with an adhesive agent; and an outer band comprising a third layer of material, said outer band comprising one of pliable paper and a non woven fabric bonded to said intermediate band with the adhesive agent;

wherein said inner band and said intermediate band include corresponding parallel ridges embossed thereupon, and wherein said inner band, intermediate band, and outer band form a wrapper for a portion of a cigarette, said wrapper being configured to have an inner circumference which essentially corresponds to an outer circumference of the cigarette, such that the ridges of the inner band extend in a longitudinal direction with respect to the cigarette, and engage an outer surface of the cigarette, and wherein the inner circumference of the inner band contacts the outer surface of the cigarette.

2. An extinguishing device as recited in claim 1, wherein said wrapper formed by the first, second and third layers includes a plurality of apertures therein, said plurality of apertures being configured to correspond to apertures in the cigarette, thereby enabling ambient air to be drawn in to a filter of the cigarette.

3. An extinguishing device as recited in claim 1, wherein said ridges in said inner and intermediate bands extend in the longitudinal direction with respect to the cigarette.

4. An extinguishing device as recited in claim 1, wherein said extinguishing device has a length, in the longitudinal direction of the cigarette, which is not less than 15 cm and not more than 25 cm.

5. An extinguishing device as recited in claim 1, wherein said wrapper is longitudinally movable along the outer surface of the cigarette.

6. An extinguishing device as recited in claim 1, wherein said adhesive agent is a naturally setting type adhesive agent.

7. An extinguishing device as recited in claim 1, wherein said intermediate band has the parallel ridges on an inner circumference thereof, and has an essentially smooth outer surface.

8. An extinguishing device as recited in claim 1, wherein said outer band has an essentially smooth inner surface and an essentially smooth outer surface.

9. An extinguishing device as recited in claim 1, wherein said wrapper is configured to be longitudinally slidable along an outer surface of the cigarette, to select an appropriate extinguishing point for the cigarette.

* * * * *